US009090861B2

(12) United States Patent
Chen et al.

(10) Patent No.: US 9,090,861 B2
(45) Date of Patent: Jul. 28, 2015

(54) STRUCTURED SOAP COMPOSITIONS

(75) Inventors: Xi Chen, Singapore (SG); Swee-How Seow, Singapore (SG); Tobias Fütterer, Singapore (SG)

(73) Assignee: RHODIA ASIA PACIFIC LTD., Singapore (SG)

( * ) Notice: Subject to any disclaimer, the term of this patent is extended or adjusted under 35 U.S.C. 154(b) by 168 days.

(21) Appl. No.: 12/228,897

(22) Filed: Aug. 15, 2008

(65) Prior Publication Data

US 2009/0048139 A1 Feb. 19, 2009

Related U.S. Application Data

(60) Provisional application No. 60/965,287, filed on Aug. 17, 2007.

(51) Int. Cl.

| | |
|---|---|
| ***C11D 17/00*** | (2006.01) |
| ***C11D 9/26*** | (2006.01) |
| ***C11D 10/04*** | (2006.01) |
| *C11D 1/52* | (2006.01) |
| *C11D 1/66* | (2006.01) |
| *C11D 1/72* | (2006.01) |

(52) U.S. Cl.

CPC ..... *C11D 17/0026* (2013.01); *C11D 9/26* (2013.01); *C11D 9/267* (2013.01); *C11D 10/04* (2013.01); *C11D 10/045* (2013.01); *C11D 10/047* (2013.01); *C11D 1/52* (2013.01); *C11D 1/667* (2013.01); *C11D 1/72* (2013.01)

USPC ..... 510/130; 510/423; 510/499; 510/503

(58) Field of Classification Search

None

See application file for complete search history.

(56) References Cited

U.S. PATENT DOCUMENTS

| | | | | |
|---|---|---|---|---|
| 4,446,043 | A | 5/1984 | Tai | |
| 4,793,943 | A * | 12/1988 | Haslop et al. | 510/397 |
| 5,147,576 | A | 9/1992 | Montague et al. | |
| 5,158,699 | A | 10/1992 | MacGilp et al. | |
| 5,556,628 | A | 9/1996 | Derian et al. | |
| 7,488,707 | B2 | 2/2009 | Frantz et al. | |
| 2003/0165455 | A1 | 9/2003 | Guillou et al. | |
| 2003/0180246 | A1 | 9/2003 | Frantz et al. | |
| 2003/0190302 | A1 | 10/2003 | Frantz et al. | |
| 2005/0276829 | A1 * | 12/2005 | Stella et al. | 424/401 |
| 2006/0040837 | A1 | 2/2006 | Frantz et al. | |
| 2006/0135627 | A1 | 6/2006 | Frantz et al. | |
| 2008/0095733 | A1 | 4/2008 | Griffin et al. | |
| 2008/0233061 | A1 | 9/2008 | Gates et al. | |
| 2009/0048139 | A1 | 2/2009 | Chen et al. | |

FOREIGN PATENT DOCUMENTS

| | | | |
|---|---|---|---|
| EP | 0081908 | A | 6/1983 |
| EP | 0346993 | A | 12/1989 |
| EP | 0572723 | A | 12/1993 |
| EP | 0675194 | A | 10/1995 |
| RU | 2277123 | C2 | 5/2006 |
| RU | 2278896 | C2 | 6/2006 |
| WO | 91/05844 | A | 5/1991 |
| WO | 98/13467 | | 4/1998 |
| WO | 0218531 | | 8/2001 |
| WO | 02053689 | | 7/2002 |

* cited by examiner

*Primary Examiner* — Necholus Ogden, Jr.

(57) ABSTRACT

A structured soap composition contains, based on 100 parts by weight of said composition, (i) from greater than 0 to about 27 parts by weight of a neutralized fatty acid, (ii) from greater than 0 to about 18 parts by weight of one or more structurant selected from alkanolamide surfactants, fatty alcohols, alkoxylated fatty alcohols, fatty acids, and fatty acid esters, (iii) from 0 to about 15 parts by weight of one or more compounds selected from amphoteric surfactants and zwitterionic surfactants, provided that the total amount of components (i), (ii), and (iii) is greater than or equal to 5 parts by weight, (iv) an amount of electrolyte effective to, in combination with components (i), (ii), and (iii) provide a structured soap composition having an opaque visual appearance and exhibiting a yield strength of greater than 0 Pascals, and (v) water.

8 Claims, No Drawings

STRUCTURED SOAP COMPOSITIONS

This application claims the benefit of U.S. Provisional Patent Application No. 60/965,287, filed Aug. 17, 2007.

FIELD OF THE INVENTION

This invention relates to soap compositions, more particularly to structured soap compositions.

BACKGROUND OF THE INVENTION

Bar soap and soap-based liquid detergents are popular personal care products in some markets. Toilet soaps are generally carefully washed free of any remaining alkali used in the saponification procedure to avoid irritation and drying of the skin. Humectants, emollients and lubricants, such as glycerine, typically are added into the soap with other additives like fragrance, coloring, and medicinal agents. Antioxidants are added to prevent the soap from turning rancid. Especially for solid bar soap, not all of the fat used to produce the soap is hydrolyzed, in order to have some fat remain to lubricate, moisturize, and smooth dry and sensitive skin. Due to the alkaline pH, good degreasing properties and good risibility of soap-based formulas are observed; typical soap-based formulas cause skin dryness issues. Furthermore, oils can typically not be added to a soap composition (especially liquid soap compositions) in a sufficiently high amount to provide moisturizing benefits, due to suspending and stability issues.

What is needed is a flowable soap-based product that minimizes skin dryness. Even more desirable would be a soap based product that provides a skin moisturizing benefit.

SUMMARY OF THE INVENTION

In a first aspect, the present invention is directed to a structured soap composition, comprising, based on 100 parts by weight of said composition, (i) from greater than 0 to about 27 pbw of a neutralized fatty acid, (ii) from greater than 0 to about 18 pbw of one or more structurant selected from alkanolamide surfactants, fatty alcohols, alkoxylated fatty alcohols, fatty acids, and fatty acid esters, (iii) from 0 to about 15 pbw of one or more compounds selected from amphoteric surfactants and zwitterionic surfactants, provided that the total amount of components (i), (ii), and (iii) is greater than or equal to 5 pbw, (iv) an amount of electrolyte effective to, in combination with components (i), (ii), and (iii) provide a structured soap composition having an opaque visual appearance and exhibiting a yield strength of greater than 0 Pascals, and (v) water.

In a second aspect, the present invention is directed to composition, comprising, in each case based on 100 pbw of the composition:

(a) from about 10 to less than 100 pbw of an aqueous structured soap phase, said structured soap phase comprising:

(i) from greater than 0 to about 27 pbw of a neutralized fatty acid, (ii) from greater than 0 to about 18 pbw of one or more structurant selected from alkanolamide surfactants, fatty alcohols, alkoxylated fatty alcohols, fatty acids, and fatty acid esters, (iii) from 0 to about 15 pbw of an amphoteric surfactant, provided that the total amount of components (i), (ii), and (iii) is greater than or equal to 5 pbw, (iv) an amount of electrolyte effective to, in combination with components (i), (ii), and (iii) provide a structured soap composition having an opaque visual appearance and exhibiting a yield strength of greater than 0 Pascals, and (v) water, and (b) from greater than 0 to about 75 pbw of a discontinuous water insoluble or partially water soluble phase dispersed in the aqueous structured soap phase.

DETAILED DESCRIPTION OF INVENTION AND PREFERRED EMBODIMENTS

Structured surfactant compositions are liquid crystalline compositions that are useful in home care applications such as liquid detergents, laundry detergents, hard surface cleansers, dish wash liquids, and personal care formulations such as shampoos, body wash, hand soap, lotions, creams, conditioners, shaving products, facial washes, baby care formulations, skin treatments. Surfactants in the structured surfactant compositions exist in the form of lamellar phases that are planar and/or in the form of spherulites. Commonly, the surfactant phase is present as spherulites, i.e., lamellar droplets, dispersed in the aqueous phase. Spherulites consist of an onion-like configuration of concentric bi-layers of surfactant molecules, between which is trapped water or electrolyte solution. Exclusively planar lamellar surfactant phases or exclusively spherulite lamellar surfactant phases or the combination of both forms can co-exist in the same composition. Structured surfactant compositions are typically pumpable, non-Newtonian compositions that have the capacity physically to suspend water insoluble particles by virtue of the presence of these lamellar surfactant phases.

As used herein, the term "surfactant" means a compound that reduces surface tension when dissolved in water.

Except when expressly stated otherwise, all the components of formulations throughout the specification are expressed in parts by weight ("pbw") and are based on 100 pbw of the structured soap composition.

As referred to herein, "lamellar phase" in reference to a surfactant or soap is a phase which comprises a plurality of stacked bilayers of surfactant or soap separated by layers of a liquid medium. Lamellar phases are typically pourable, non-Newtonian, anisotropic compositions that are cloudy looking and exhibit a characteristic "smeary" appearance on flowing. Lamellar phases can exist in several different forms, including layers of parallel sheets, each sheet of which is a bilayer of surfactant or soap, and spherulites formed from layers of concentric spherical shells, each shell of which is a bilayer of surfactant or soap. The spherulites are typically between 0.1 and 50 microns in diameter and so differ fundamentally from micelles.

The composition of the present invention comprises an ordered liquid crystal phase, typically a lamellar liquid crystal phase, more typically a spherulitic lamellar liquid crystal phase, and exhibits, on visual inspection, an opaque appearance due to the presence of the ordered liquid crystal phase.

As used herein, the term "opaque" means not completely transparent to light and ranges from a hazy translucent appearance through a turbid appearance to a uniform, saturated white appearance. In one embodiment, the structured soap composition of the present invention ranges from a turbid appearance to a uniform, saturated white appearance.

The ordered liquid crystal phase, alone or more usually interspersed with an aqueous phase, provides a rheology which is sufficient, when the system is at rest, to immobilize any suspended particles, but which is sufficiently low to allow the system to be pumped like a normal liquid. Such systems may display very low apparent viscosities when stirred, pumped or poured and yet be capable of maintaining particles, sometimes of millimeter or larger size, in suspension.

In one embodiment, the composition of the present invention exhibits shear-thinning viscosity. As used herein in reference to viscosity, the terminology "shear-thinning" means that such viscosity decreases with an increase in shear rate. Shear-thinning may be characterized as a "non-Newtonian" behavior, in that it differs from that of a classical Newtonian fluid, for example, water, in which viscosity is not dependent on shear rate.

As used herein, "yield strength" refers to the magnitude of the applied force required to induce the composition to flow. In one embodiment, the composition exhibits a yield strength of greater than 0.1 Pascals ("Pa"), more typically from about 1 to about 100 Pa, and even more typically from about 1 to about 10 Pa, as determined by measurements using a controlled stress/strain rheometer at two or more shear rates.

In one embodiment, the structured soap composition of the present invention is capable of suspending water insoluble or partially water-soluble components.

As used herein in reference to a component of an aqueous composition, the terminology "water insoluble or partially water-soluble components" means that the component is present in the aqueous composition at a concentration above the solubility limit of the component so that, in the case of a water insoluble component, the component remains substantially non-dissolved in the aqueous composition and, in the case of a partially water-soluble component, at least a portion of such component remains undissolved in the aqueous composition. The water insoluble or partially water-soluble components may, for example, be in the form of solid particles, of continuous or discontinuous liquid phases, such as oil droplets, or of discontinuous gas phases, such as air bubbles.

As used herein, characterization of an aqueous composition as "capable of suspending", or as being "able of suspend" water insoluble or partially water-soluble components means that the composition substantially resists flotation of such components in the composition or sinking of such components in such composition so that such components appear to be neutrally buoyant in such composition and remain at least substantially suspended in such composition under the anticipated processing, storage, and use conditions for such aqueous composition. The ability to suspend water insoluble or partially water-soluble components is one manifestation of the non-zero yield strength of the present invention, that is, the resistance of the structured soap composition of the present invention to deformation at low stresses is sufficient to balance the gravitational forces acting on water insoluble or partially water-soluble components, so that the components remain suspended in the structured soap composition.

The structured soap composition of the present invention typically comprises, based on 100 pbw of the composition, greater than 40 pbw, more typically, from about 40 to about 90 pbw, and still more typically from about 58 to about 90 pbw, water.

As used herein, the terminology "($C_x$-$C_y$)" in reference to an organic group, wherein x and y are each integers, indicates that the group may contain from x carbon atoms to y carbon atoms per group.

As used herein, the term "alkyl" means a monovalent saturated straight chain or branched hydrocarbon group, more typically a monovalent saturated ($C_6$-$C_{30}$) hydrocarbon group, such as octyl, nonyl, decyl undecyl, dodecyl, tridecyl, tetradecyl, pentadecyl, hexadecyl, heptadecyl, octadecyl, methyldodecyl, ethylundecyl, or dimethylundecyl. Alkyl groups are also referred to by their respective trivial names, for example, "lauryl" and "dodecyl" each refer to $C_{12}$ alkyl and "tetradecyl" and "coco" each refer to $C_{14}$alkyl.

As used herein, the term "alkenyl" means a monovalent unsaturated straight chain or branched hydrocarbon group, more typically a monovalent unsaturated ($C_6$-$C_{30}$) hydrocarbon group, such as octenyl, nonenyl, decenyl undecenyl, dodecenyl, tridecenyl, tetradecenyl, pentadecenyl, hexadecenyl, heptadecenyl, octadecenyl, methyldodecenyl, ethylundecenyl, or dimethylundecenyl.

As used herein, the term "cation" means a cation that is acceptable for use in a personal care composition, including sodium, potassium, lithium, calcium, magnesium, and ammonium cations, as well as ($C_1$-$C_6$)alkylammonium and ($C_1$-$C_6$)alkoxylammonium cations, such as isopropylammonium, monoethanolammonium, diethanolammonium, and triethanolammonium cation. Potassium salts are generally more soluble than the sodium salts. Mixtures of the above cations may be used.

In one embodiment, the structured soap composition of the present invention comprises, based on 100 pbw of the composition, from about 1 to about 20 pbw, more typically from about 2 to about 15 pbw, even more typically from about 3 to about 15 pbw, even more typically from about 4 to about 15 pbw, and still more typically from about 4 to about 12 pbw, of the neutralized fatty acid.

In one embodiment, the neutralized fatty acid component of the structured soap composition of the present invention comprises one or more compounds selected from:

(a) compounds according to structure (I) and compounds according to structure (II):

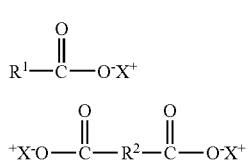

(I)

(II)

wherein:

$R^1$ is ($C_6$-$C_{30}$)alkyl or ($C_6$-$C_{30}$)alkenyl, $R^2$ is ($C_6$-$C_{30}$)alkylene or ($C_6$-$C_{30}$)alkenylene, and $X^+$ is, in each case, a cation, and (b) neutralized fatty acid oligomers.

In one embodiment, the neutralized fatty acid is according to structure (I).

In one embodiment, $R^1$ is nonenyl, tridecenyl, oleyl, pentadecenyl, heptadecenyl, linoleyl, linolenyl, or behenyl, more typically, nonenyl, tridecenyl, linoleyl, or linolenyl.

In one embodiment, $X^+$ is potassium.

Suitable neutralized fatty acids are obtained, for example, by neutralization of a fatty acid with an alkali metal hydroxide. Suitable fatty acids include saturated or unsaturated mono- or di-fatty acids, more typically ($C_6$-$C_{30}$) fatty acids, such as, for example, sebacic acid, lauric acid, myristic acid, palmitic acid, stearic acid, oleic acid, linoleic acid, linolenic acid, ricinoleic, archidic acid, behenic acid, erucic acid, and mixtures thereof, including vegetable oils, such as, for example, tall oil, rapeseed oil, canola oil, soy oil, coconut oil, castor oil, corn oil, olive oil, sunflower oil, cottonseed oil, palm oil, peanut oil, sesame oil, safflower oil, linseed oil, flax seed oil, palm kernel oil, and mixtures thereof.

In one embodiment, the neutralized fatty acid component of the structured soap composition of the present invention comprises one or more neutralized fatty acid oligomers, such as, for example, a fatty acid dimer or fatty acid trimer. Suitable neutralized fatty acid oligomers include, for example, neutralized dimers and trimers of sebacic acid, neutralized dimers and trimers of oleic acid, neutralized dimers and trimers of stearic acid, neutralized dimers and trimers of erucic acid, and mixtures thereof.

Suitable structurants include alkanolamides, fatty alcohols, alkoxylated fatty alcohols, fatty acids, fatty acid esters, and mixtures thereof. In one embodiment, the structurant is selected from alkanolamides, fatty alcohols, alkoxylated fatty alcohols, fatty acids, fatty acid esters.

In one embodiment, the structured soap composition of the present invention comprises, based on 100 pbw of the composition, from about 1 to about 18 pbw, more typically from about 2 to about 18 pbw, even more typically from about 3 to about 15 pbw, even more typically from about 3 to about 12 pbw, and still more typically from about 4 to about 10 pbw, of structurant.

In one embodiment, the structurant component of the composition of the present invention comprises one or more alkanolamide compounds, more typically alkanolamide compounds according to structure (III):

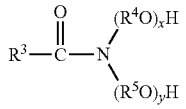

(III)

wherein:

$R^3$ is ($C_5$-$C_{24}$) saturated or unsaturated, straight chain or branched aliphatic group, $R^4$ and $R^5$ are the same or different, $C_2$-$C_4$ straight chain or branched aliphatic groups, x is an integer from 0 to 10, y is an integer from 1 to 10, and the sum of x and y is less than or equal to 10.

Suitable alkanolamides include aliphatic acid alkanolamides, such as cocamide MEA (coco monoethanolamide) and cocamide MIPA (coco monoisopropanolamide), cocamide DEA (coco diethanolamide), lauramide MEA (lauryl monoethanolamide), lauramide DEA (lauryl diethanolamide), and alkoxylated alkanolamides, such as PEG-5 cocamide MEA (compound according to structure (III) above, wherein $R^3$ is ($C_{12}$-$C_{12}$)alkyl, $R^4$ and $R^5$ are each $C_2H_4$, and x+y=5), as well as mixture of any of the above.

In one embodiment, the structurant component of the composition of the present invention comprises one or more fatty alcohols and/or alkoxylated fatty alcohols. More typically, the structurant component comprises one or more fatty alcohol and/or alkoxylated fatty alcohol compounds according to formula (IV):

$$R_6—O—[C_pH_{2p}O]_q—H \quad (IV)$$

wherein $R^6$ is ($C_8$-$C_{22}$)alkyl or ($C_8$-$C_{22}$)alkenyl, p is 2, 3, or 4, more typically 2, q is an integer of from 0 to about 100, more typically from 0 to about 50, or a salt thereof.

In one embodiment, q is 0.

In one embodiment, q is an integer of from 1 to about 30.

Suitable fatty alcohols include, for example, decyl alcohol, lauryl alcohol, tridecyl alcohol, myristyl alcohol, cetyl alcohol, stearyl alcohol, oleyl alcohol, linoleyl alcohol, linolenyl alcohol, and mixtures thereof.

Suitable alkoxylated alcohol surfactant compounds include, for example, ethoxylated (15) tridecyl alcohol, ethoxylated (7) lauryl alcohol, ethoxylated (20) oleyl alcohol, ethoxylated (15) stearyl alcohol, and mixtures thereof. In each case, the number of moles of ethylene oxide-derived repeat units in the ethylene oxide chain for that compound, i.e., the value of "q" in the corresponding formula (IV for the compound, is indicated in the parentheses.

In one embodiment, the structurant component of the composition of the present invention comprises one or more fatty acids or fatty acid esters.

Suitable fatty acids comprise saturated or unsaturated mono- or di-fatty acids, typically ($C_6$-$C_{30}$) fatty acids, such as, for example, lauric acid, myristic acid, palmitic acid, stearic acid, oleic acid, linoleic acid, behenic acid, erucic acid, ricinoleic acid, elaidic acid, arichidonic acid, myristoleic acid, fatty acid oligomers, such as fatty acid dimers and trimers, and mixtures thereof.

Suitable fatty acid esters include, for example, butyl myristate, cetyl palmitate, decyloleate, glyceryl laurate, glyceryl ricinoleate, glyceryl stearate, glyceryl isostearate, glyceryl oleate, hexyl laurate, isobutyl palmitate, isocetyl stearate, isopropyl isostearate, isopropyl laurate, isopropyl linoleate, isopropyl myristate, isopropyl palmitate, isopropyl stearate, propylene glycol monolaurite, propylene glycol ricinoleate, propylene glycol stearate, and propylene glycol isostearate.

In one embodiment, the structured soap composition of the present invention further comprises an amphoteric surfactant.

Suitable amphoteric surfactants include for example, derivatives of aliphatic secondary and tertiary amines in which the aliphatic radical can be straight chain or branched and wherein one of the aliphatic substituents contains from about 8 to about 18 carbon atoms and one contains an anionic water-solubilizing group as well as mixtures thereof. Specific examples of suitable amphoteric surfactants include the alkali metal, alkaline earth metal, ammonium or substituted ammonium salts of alkyl amphocarboxy glycinates and alkyl amphocarboxypropionates, alkyl amphodipropionates, alkyl amphodiacetates, alkyl amphoglycinates, and alkyl amphopropionates, as well as alkyl iminopropionates, alkyl iminodipropionates, and alkyl amphopropylsulfonates, such as for example, cocoamphoacetate cocoamphopropionate, cocoamphodiacetate, lauroamphoacetate, lauroamphodiacetate, lauroamphodipropionate, lauroamphodiacetate, cocoamphopropyl sulfonate caproamphodiacetate, caproamphoacetate, caproamphodipropionate, and stearoamphoacetate.

In one embodiment, the structured soap composition of the present invention comprises, based on 100 pbw of the composition, from greater than 0 to about 15 pbw, more typically from about 1 to about 12 pbw, and even more typically from about 3 to about 8 pbw, of an amphoteric surfactant.

In one embodiment, the structured soap composition of the present invention further comprises a zwitterionic surfactant.

Suitable zwitterionic surfactants include alkyl betaines, such as cocodimethyl carboxymethyl betaine, lauryl dimethyl carboxymethyl betaine, lauryl dimethyl alpha-carboxyethyl betaine, cetyl dimethyl carboxymethyl betaine, lauryl bis-(2-hydroxy-ethyl)carboxy methyl betaine, stearyl bis-(2-hydroxy-propyl)carboxymethyl betaine, oleyl dimethyl gamma-carboxypropyl betaine, and lauryl bis-(2-hydroxypropyl)alpha-carboxyethyl betaine, amidopropyl betaines, and alkyl sultaines, such as cocodimethyl sulfopropyl betaine, stearyldimethyl sulfopropyl betaine, lauryl dimethyl sulfoethyl betaine, lauryl bis-(2-hydroxy-ethyl)sulfopropyl betaine, and alkylamidopropylhydroxy sultaines.

In one embodiment, the structured soap composition of the present invention comprises, based on 100 pbw of the composition, from greater than 0 to about 15 pbw, more typically from about 1 to about 10 pbw, and still more typically from about 2 to about 6 pbw, of a zwitterionic surfactant.

In one embodiment, the combined total amount of components (i) and (ii) of the structured soap composition is greater than or equal to about 3 pbw, more typically greater than or equal to about 4 pbw, even more typically greater than or equal to about 6 pbw, and still more typically greater than or equal to about 8 pbw, per 100 pbw of the structured soap composition.

In one embodiment, the combined total amount of components (i), (ii), and (iii) of the structured soap composition is greater than or equal to about 6 pbw, more typically greater than or equal to about 8 pbw, even more typically greater than or equal to about 10 pbw, still more typically greater than or equal to about 12 pbw, per 100 pbw of the structured soap composition. In some embodiments, the combined total amount of components (i), (ii), and (iii) of the structured soap composition is greater than or equal to about 15 pbw per 100 pbw of the structured soap composition.

The electrolyte component of the structured soap composition of the present invention, in combination with the neutralized fatty acid, structurant and surfactant components of the structured soap composition of the present invention induces formation of a lamellar liquid crystal surfactant phase, from which the opaque visual appearance and the non-zero yield strength of the structured soap composition of the present invention arise.

In one embodiment, the structured soap composition of the present invention comprises, based on 100 pbw of the structured soap composition, from greater than 0 to about 20 pbw, more typically from about 1 to about 15 pbw, even more typically from about 1 to about 12 pbw, even more typically from about 2 to about 12 pbw, and still more typically from about 3 to about 10 pbw, of an electrolyte. In some embodiments, the structured soap composition of the present invention comprises, based on 100 pbw of the structured soap composition, from about 3 to about 20 pbw, more typically from about 5 to about 20 pbw, even more typically from about 7 to about 18 pbw, of an electrolyte.

Suitable electrolytes include organic salts, inorganic salts, and mixtures thereof, as well as polyelectrolytes, such as uncapped polyacrylates, polymaleates, or polycarboxylates, lignin sulfonates or naphthalene sulfonate formaldehyde copolymers. The electrolyte typically comprises a salt having a cationic component and an anionic component. Suitable cations may be monovalent or multivalent, may be organic or inorganic, and include, for example, sodium, potassium, lithium, calcium, magnesium, cesium, and lithium cations, as well as mono-, di- tri- or quaternary ammonium or pyridinium cation. Suitable anions may be a monovalent or multivalent, may be organic or inorganic, and include, for example, chloride, sulfate, nitrate, nitrite, carbonate, citrate, cyanate acetate, benzoate, tartarate, oxalate, phosphate, and phosphonate anions. Suitable electrolytes include, for example, salts of multivalent anions with monovalent cations, such as potassium pyrophosphate, potassium tripolyphosphate, and sodium citrate, salts of multivalent cations with monovalent anions, such as calcium chloride, calcium bromide, zinc halides, barium chloride, and calcium nitrate, and salts of monovalent cations with monovalent anions, such as sodium chloride, potassium chloride, ammonium chloride, potassium iodide, sodium bromide, ammonium bromide, alkali metal nitrates, and ammonium nitrates.

Electrolyte may be added as a separate component or in combination with other components of the composition of the present invention.

The structured soap composition may, optionally, further comprise up to about 2 pbw, more typically up to about 1 pbw, per 100 pbw of the composition of additional surfactants, including cationic surfactants, nonionic surfactants, in excess of the amount used as the above described structurant, amphoteric surfactant, and zwitterionic surfactant, and mixtures thereof.

Suitable cationic surfactants include quaternary ammonium compounds such as cetyl trimethyl ammonium bromide (also known as CETAB or cetrimonium bromide), cetyl trimethyl ammonium chloride (also known as cetrimonium chloride), myristyl trimethyl ammonium bromide (also known as myrtrimonium bromide or Quaternium-13), stearyl dimethyl distearyldimonium chloride, dicetyl dimonium chloride, stearyl octyldimonium methosulfate, dihydrogenated palmoylethyl hydroxyethylmonium methosulfate, isostearyl benzylimidonium chloride, cocoyl benzyl hydroxyethyl imidazolinium chloride, dicetyl dimonium chloride and distearyldimonium chloride; isostearylaminopropalkonium chloride or olealkonium chloride; behentrimonium chloride; as well as mixtures thereof.

Suitable nonionic surfactants include amine oxides such lauramine oxide, cocamine oxide, stearamine oxide, stearamidopropylamine oxide, palmitamidopropylamine oxide, decylamine oxide, fatty alcohols, alkoxylated fatty alcohols, fatty acids, fatty acid esters, and mixtures thereof. Suitable fatty alcohols, alkoxylated fatty alcohols, fatty acids and fatty acid esters include those described above as structurants.

The structured soap composition of the present invention may optionally further comprise one or more preservatives, such as benzyl alcohol, methyl paraben, propyl paraben, or imidazolidinyl urea, and DMDM hydantoin, and may optionally further comprise one or more pH adjusting agents, such as citric acid, succinic acid, phosphoric acid, sodium hydroxide, or sodium carbonate.

In general, the structured soap composition of the present invention is made by combining and mixing the neutralized fatty acid, structurant, surfactant and electrolyte, and water components. The neutralized fatty acid component may be added to the other components in the form of neutralized fatty acid or added in the form of fatty acid and then neutralized, e.g., by adding base, such as NaOH or KOH, to form the neutralized fatty acid in situ. In one embodiment, the structured soap composition is made by combining and mixing the neutralized fatty acid and water, adding the structuring agent and surfactants, then adding the electrolyte, and optionally, adjusting the pH and/or adding a preservative. Alternatively, the electrolyte may be added with the neutralized fatty acid and the water. The structured soap composition can also be subjected to high shear mixing. As used herein, the term "high shear mixing" refers to mixing under high shear conditions, typically at a shear rate of greater than or equal to about 1,000 $s^{-1}$, more typically greater than or equal to about 3,500 $s^{-1}$ The structured soap composition may be subjected to a high shear mixing in known mixing equipment, such as, for example, a high shear mixer or a homogenizer.

In one embodiment, the pH of the structured soap composition of the present invention is from 8.2 to 11, more typically from 8.5 to 10.6.

The composition of the present invention is capable of suspending water-insoluble particles or partially water-soluble components, such as vegetable oils, hydrocarbon oils, silicone oils, solid particles, abrasives, and similar articles. The composition provides a means to include otherwise difficult to incorporate components in surfactant mixtures resulting in cosmetic preparations with multi-functional benefits including, in some cases, cleansing, moisturizing, improved skin feel, exfoliation/abrasion, novel appearance, or a combination of these benefits.

The ability of a composition to suspend water insoluble or partially water-soluble components is typically evaluated by mixing the composition with sufficient vigor to entrap air bubbles in the composition and then visually observing whether the air bubbles remain entrapped in the composition for a defined period of time, such as for example, 12 to 24 hours, under defined environmental conditions, such as for example, room temperature. In one embodiment, the composition of the present invention is capable of suspending air bubbles for at least 1 week, and more typically for at least 3 months. A composition that is capable of suspending air bubbles for at least 12 hours at room temperature is deemed to be generally capable of suspending water insoluble or partially water-soluble components in the composition under generally anticipated processing, storage, and use conditions for such composition. For components other than air, the result of the air suspension test should be confirmed by conducting an analogous suspension test using the component of interest. For unusually rigorous processing, storage and/or use conditions, more rigorous testing may be appropriate.

In one embodiment, the ability to suspend water insoluble or partially water-soluble components is evaluated under more rigorous conditions, that is, the mixed samples are visually evaluated after subjecting the samples to one or more freeze/thaw cycles, wherein each freeze/thaw cycle consists of 12 hours at −10° C. and 12 hours at 25° C. In one embodiment, composition of the present invention remains capable of suspending air bubbles after one freeze/thaw cycle, more typically after 3 freeze/thaw cycles.

The composition of the present invention is useful in, for example, personal care applications, such as shampoos, body wash, hand soap, lotions, creams, conditioners, shaving products, facial washes, neutralizing shampoos, personal wipes, and skin treatments, and in home care applications, such as liquid detergents, laundry detergents, hard surface cleansers, dish wash liquids, toilet bowl cleaners, as well as other applications, such as oil field and agrochemical applications.

In one embodiment, the personal care composition of the present invention comprises one or more "benefit agents" that is, materials that provide a personal care benefit, such as moisturizing or conditioning, to the user of the personal care composition, such as, for example, emollients, humectants, such as glycerin, moisturizers, conditioners, polymers, vitamins, abrasives, UV absorbers, antimicrobial agents, anti-dandruff agents, fragrances, and/or appearance modifying additives, such as, for example, colored particles or reflective particles, which may be in the form of a solid, liquid, or gas and may be insoluble or are only partly soluble in the structured soap composition. Mixtures of the benefit agents may be used.

In one embodiment, the personal care composition comprises, in each case based on 100 pbw of the composition, from about 50 to less than 100 pbw, more typically from about 70 to about 99 pbw of an aqueous structured soap phase comprising an aqueous structured soap composition according to the present invention, as described above, and from greater than 0 to about 50 pbw, more typically from about 1 to about 30 pbw, a discontinuous water insoluble or partially water soluble phase dispersed in the aqueous structured soap phase.

In one embodiment, the water insoluble or partially water soluble phase comprises an oil. Suitable oils include vegetable oils, such as arachis oil, castor oil, cocoa butter, coconut oil, corn oil, cotton seed oil, olive oil, palm kernel oil, rapeseed oil, sunflower oil, safflower seed oil, sesame seed oil, soybean oil, shea butter, avocado oil, rice bran oil, jojoba oil, grape seed oil, sweet almond oil, canola oil, apricot oil, walnut oil, wheat germ oil, mineral oils, such as petrolatum, and silicone oils, such as polydimethylsiloxane, as well as mixtures of any of such oils.

In one embodiment, the personal care composition comprises, in each case based on 100 pbw of the composition:

(a) from about 5 to less than 100 pbw, more typically from about 10 to about 25 pbw, of an aqueous structured soap phase, said structured soap phase comprising:

(i) from greater than 0 to about 27 pbw of a neutralized fatty acid, (ii) from greater than 0 to about 18 pbw of one or more structurant selected from alkanolamide surfactants, fatty alcohols, alkoxylated alcohols, fatty acids, and fatty acid esters, (iii) from 0 to about 15 pbw of one or more compounds selected from amphoteric surfactants and zwitterionic surfactants, provided that the total amount of components (i), (ii), and (iii) is greater than or equal to 5 pbw, (iv) an amount of electrolyte effective to, in combination with components (i), (ii), and (iii) provide a structured soap composition having an opaque visual appearance and exhibiting a yield strength of greater than 0 Pascals, and (v) water, and (b) from greater than 0 to about 75 pbw, more typically from about 5 to about 55 pbw of a discontinuous water insoluble or partially water soluble phase that comprises one or more oils, more typically one or more vegetable oils, and is dispersed in the aqueous structured soap phase.

The aqueous structured soap phase of the personal care composition corresponds to the above described structured soap composition of the present invention and the above description of the structured soap composition of the present invention thus applies to the structured soap phase of the personal care composition as well.

The personal care composition is typically made by combining a structured soap composition according to the present invention, which forms the aqueous structured soap phase of the personal care composition with one or more water insoluble or partially water soluble components, which forms the water insoluble or partially water soluble phase of the personal care composition.

The personal care composition of the present invention is typically made by combining and mixing the neutralized fatty acid, structurant, surfactant, electrolyte, and water components to form the aqueous structured soap phase of the personal care composition and then adding one or more oils to form the discontinuous water insoluble or partially water soluble phase of the personal care composition.

In one embodiment, the personal composition is a skin care composition and comprises, based on 100 pbw of the composition, from about 5 to less than 100 pbw, more typically from about 5 to about 25 pbw, and even more typically from about 10 to about 15 pbw, of the aqueous structured soap phase, and from greater than 0 to about 75 pbw, more typically from about 5 to about 55 pbw, more typically from about 5 to about 30, and even more typically from about 10 to about 30 pbw, and still more typically from about 10 to about 25 pbw, of the discontinuous water insoluble or partially water soluble phase.

In another embodiment, the personal composition is a hair care composition and comprises, based on 100 pbw of the composition, from about 5 to less than 100 pbw, more typically from about 5 to about 25 pbw, and even more typically from about 10 to about 15 pbw, of the aqueous structured soap phase, and from greater than 0 to about 75 pbw, more typically from about 5 to about 55 pbw, and even more typically from about 10 to about 30 pbw, of the discontinuous water insoluble or partially water soluble phase.

The structured soap composition of the invention provides a stable structured composition having non-zero yield strength even in the absence of a polymer component.

In some applications, a polymer component may be perceived as imparting an undesirably sticky skin feel to the composition and it is preferred that polymer not be included in the composition or that the amount of polymer be minimized.

In some applications, the presence of a polymer component is not objectionable. In which case, one embodiment the personal care composition of the present invention further comprises, based on 100 pbw of the composition, up to about 5 pbw, more typically up to about 2 pbw, of a polymer. Suitable polymers include, for example, agars, alginates, arabinoxylans, carrageenans, gelatins, gellans, β-glucans, gum arabic, locust bean gums, pectins, succinoglycans, xanthan gums, guar gums, guar gum derivatives, such as hydroxypropyl guars (Jaguar™ HP-8, Jaguar HP-105, Jaguar HP-60, Jaguar HP-120, Jaguar C-162), starches, starches and starch derivatives such as sodium hydroxypropyl starch phosphate (Pure-Gel 980 and Pure-Gel 998 from Grain Processing Corporation), cellulose and cellulose derivatives, such as carboxyalkyl celluose, hydroxyalkyl cellulose alkyl cellulose, quaternary ammonium derivatives of hydroxyethylcellulose, acrylate polymers, such as acrylate/aminoacrylate/$C_{10-30}$ alkyl PEG-20 itaconate copolymer (Structure-Plus™ from National Starch), cationic polymers (Rheovis CSP, Rheovis CDE, Rheovis CDP from Ciba), polyacrylimidomethylpropane sulfonate/polyquaternium-4 (Plexagel™ ASC from ISP), hydrophobically modified nonionic polyols (Acusol™ 880, Acusol 882 from Rohm & Haas), and PEG-150 Distearate.

In those embodiments of the personal care composition according to the present invention that further comprise an optional polymer component, the polymer provides increased viscosity and may provide improved stability and increase the yield strength of the structured soap composition compared to an analogous composition that lacks the polymer.

The personal care composition according to the present invention may optionally further comprise, based on 100 pbw of the personal care composition and independently for each such ingredient, from about 0 to about 10 pbw, typically from 0.5 pbw to about 5.0 pbw, of other ingredients known in the art, such as, for example, preservatives such as benzyl alcohol, methyl paraben, propyl paraben and imidazolidinyl urea, electrolytes, such as sodium chloride, sodium sulfate, polyvinyl alcohol, and sodium citrate; pH adjusting agents such as citric acid, succinic acid, phosphoric acid, sodium hydroxide, sodium carbonate; dyes, and sequestering agents such as disodium ethylenediamine tetra-acetate.

In one embodiment, the personal care composition of the present invention comprises a structured soap component according to the present invention that forms a first macroscopic "phase" (which may itself comprise a plurality of phases, including aqueous phases, planar lamellar surfactant phases and spherulitic lamellar surfactant phases, as discussed above) and the composition further comprises one or more additional macroscopic phases that are at least substantially distinct from such first phase. As used herein in reference to the phases of a multiphase embodiments of the present invention, the terminology "substantially distinct" means that the phases each exhibit substantially homogeneous properties within a given phase and that the phases differ with respect to at least one characteristic or property, such as for example, visual characteristics, such as color, clarity, pearlescence, or physical/chemical properties, such as viscosity, lubricity, and/or benefit agent content.

The structured soap composition of the present application and its use as the structured soap phase of the personal care composition of the present application enables high loading of the oil phase.

EXAMPLES

The formulations in the Table 1 below were made by combining the ingredients in the relative amounts set forth below in TABLE I.

Lauric acid was neutralized by KOH to obtain a pure soap base with a $C_{12}$ alkyl chain. Oleic Acid was neutralized by KOH to obtain a pure soap base with a $C_{18}$ alkyl chain.

TABLE I

| | Amount (wt %, based on active ingredient) | | | | | | | |
|---|---|---|---|---|---|---|---|---|
| Example# | 1 | 2 | 3 | 4 | 5 | 6 | 7 | 8 |
| Neutralized lauric acid ($C_{12}H_{23}OOK$ salt) | 10 | 5.4 | 0 | 3.15 | 5.4 | 5.4 | 3.15 | 10 |
| Neutralized Oleic Acid ($C_{18}H_{33}O_2K$ salt) | 0 | 0 | 9 | 2.1 | 0 | 0 | 2.1 | 0 |
| cocamide MEA | 5 | 6 | 6 | 4.5 | 6 | 6 | 4.5 | 5 |
| coco amidopropyl betaine | 0 | 3.6 | 0 | 5.25 | 0 | 3.6 | 5.25 | 0 |
| Sodium lauroamphoacetate | 0 | 0 | 0 | 0 | 3.6 | 0 | 0 | 0 |
| KCl | 0 | 12 | 2 | 0 | 12 | 10 | 0 | 0 |
| NaCl | 2 | 0 | 0 | 0 | 0 | 0 | 0 | 2 |
| $NH_4Cl$ | 0 | 0 | 0 | 1.5 | 0 | 0 | 1.0 | 0 |
| Kathon CG | 0.05 | 0.05 | 0.05 | 0.05 | 0.05 | 0.05 | 0.05 | 0.05 |
| Olive oil | 0 | 0 | 0 | 0 | 0 | 20 | 10 | 10 |
| Guar Gum | 0 | 0 | 0 | 0 | 0 | 0 | 0 | 0.6 |
| Xanthan Gum | 0 | 0 | 0 | 0 | 0 | 0.5 | 1.0 | 0 |

TABLE I-continued

| | Amount (wt %, based on active ingredient) | | | | | | | |
|---|---|---|---|---|---|---|---|---|
| Example# | 1 | 2 | 3 | 4 | 5 | 6 | 7 | 8 |
| pH | 8.5 | 8.7 | 10.6 | 8.5 | 10 | 9.3 | 8.6 | 8.6 |
| Water | To 100 | To 100 | To 100 | To 100 | To 100 | To 100 | To 100 | To 100 |

The compositions of Examples 1-8 were each stable, homogeneous, opaque, mobile, and spherulitic. The compositions were each stable suspensions which did not separate after 3 months at laboratory ambient temperature. The properties of these formulations were summarized in TABLE II, wherein a "+" sign indicates that the Example exhibited the property listed in the Table, followed by the descriptions of the methods to determine these properties.

TABLE II

| | Example # | | | | | | | |
|---|---|---|---|---|---|---|---|---|
| Property | 1 | 2 | 3 | 4 | 5 | 6 | 7 | 8 |
| Appearance (opaque & cloudy) | + | + | + | + | + | + | + | + |
| Stable | + | + | + | + | + | + | + | + |
| Alkaline pH (pH > 7) | + | + | + | + | + | | + | + |
| Yield Strength (Pa) | >0 | >0 | >0 | >0 | >0 | >0 | >0 | >0 |
| Viscosity (cps) | 1580 | 1280 | 4100 | 2340 | 3520 | 8980 | 16020 | 8280 |

The visual appearance of the compositions of Examples 1-8 was determined qualitatively using a visual method of turbidity determination. Briefly, the visual method involves looking through a determined path length of the formulation to a visual target and determining if the visual target is legible or recognizable. This target may be a straight line, a set of parallel lines, a number or a letter printed on white paper. In each case, a sample was placed in a glass beaker such that the height from the bottom of the beaker to the top surface of the formulation was 4 inches. After confirming that the sample was free of air bubbles, a piece of paper with a visual target was placed under the beaker. The target was viewed through the top surface of the sample. If the target as viewed through the sample appeared similar to the target as viewed in the absence of sample, the formulation was judged to be of acceptable clarity and received a "pass" rating. If the target as viewed through the sample appeared significantly hazy, or out of focus, compared to the target as viewed in the absence of sample, the sample was judged to be of unacceptable clarity and received a "fail" rating.

The stability of the compositions of Examples 1-8 was measured as follows. Samples were held at room temperature in sealed containers for at least 70 days and at elevated temperature (50° C.) for 14 days. "Stability" was defined as the ability of the composition to maintain a homogeneous physical appearance or show no more than a 40% decrease in viscosity under such combination of time and temperature.

The pH values of the compositions of Examples 1-8 were measured by a pH meter (Horiba, Kyoto, Japan, Model: D-51 & F-21)

Yield stress, or yield point, is the amount of force required to initiate flow of a semi-solid and was measured for the compositions of Examples 1-8 as follows. A rheometer (RE-OLOGOCA instruments AB rheometer) equipped with a cone and plate (4 cm, 1 degree) was programmed to oscillate from 0.1% to 500% strain ($\gamma$) at a frequency of 1 cycle per second and a measurement interval of 20 seconds to obtain the elastic modulus (G'), viscous modulus (G") and stress ($\sigma$) profiles. At low deformation (strain $\gamma$), elastic modulus G' is larger than viscous modulus G", the formulations are more solid-like. At high deformation (strain $\gamma$), G">G', the formulations tends to be more liquid-like. According to the definition of yield stress (a measure of the lowest shear stress which is needed to break the structure and start the flow), the stress value corresponding to the crossover point of G' and G" is determined as the yield stress $\sigma_0$. The yield stress $\sigma_0$ was noted and recorded. The temperature was maintained at a constant 25° C.

Viscosity Measurement

The viscosity was measured using a Brookfield DV-II+ viscometer equipped with a S04 or S05 spindle at 10 rpm as follows. A wide mouth jar (~1.5 inches wide ~3 inches tall) was filled with sample composition at 25° C. In each case, the height of the sample composition in the wide mouth jar was at least 3 inches, the spindle was lowered into the product (~1 inch) and allow to remain in the jar with the motor off for 2 minutes, and then the motor was turned on and the spindle was allowed to turn for 1 minute before noting the reading the viscosity.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

The invention claimed is:

1. A personal care composition, consist of, in each case based on 100 parts by weight of the composition:

(a) an aqueous structured soap phase, said structured soap phase comprising:

(i) from about 1 to about 20 parts by weight of a neutralized fatty acid, (ii) from greater than 0 to about 18 parts by weight of one or more structurant selected from alkanolamide surfactants, fatty alcohols, alkoxylated fatty alcohols, fatty acids, and fatty acid esters, (iii) from 0 to about 15 parts by weight of an amphoteric surfactant, provided that the total amount of components (i), (ii), and (iii) is greater than or equal to 5 parts by weight, (iv) an amount of electrolyte effective to, in combination with components (i), (ii), and (iii) provide a lamellar liquid crystal structured soap phase having an opaque visual appearance and exhibiting a yield strength of greater than 0 Pascals, and (v) water, and (b) from about 5 to about 55 parts by weight of a discontinuous water insoluble phase dispersed in the aqueous structured soap phase, wherein the water insoluble phase comprises one or more vegetable oils, and wherein the composition comprises, based on 100 parts by weight of the structured soap composition, up to about 20 parts by weight of the electrolyte.

2. The composition of claim 1, wherein the one or more vegetable oils comprise one or more compounds selected from arachis oil, castor oil, cocoa butter, coconut oil, corn oil, cotton seed oil, olive oil, palm kernel oil, rapeseed oil, sunflower oil, safflower seed oil, sesame seed oil, soybean oil, shea butter, avocado oil, rice bran oil, jojoba oil, grape seed oil, sweet almond oil, canola oil, apricot oil, walnut oil, and wheat germ oil.

3. The composition of claim 1, wherein the composition comprises, based on 100 parts by weight of the composition, from about 2 to about 15 parts by weight of the neutralized fatty acid.

4. The composition of claim 1, wherein the composition comprises, based on 100 parts by weight of the composition from about 4 to about 12 parts by weight of the neutralized fatty acid.

5. The composition of claim 1, wherein the neutralized fatty acid component of the composition of the present invention comprises one or more compounds selected from:

(a) compounds according to structure (I) and compounds according to structure (II):

(I)

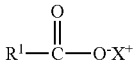

(II)

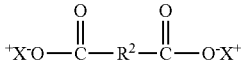

wherein:

$R^1$ is $(C_6\text{-}C_{30})$alkyl or $(C_6\text{-}C_{30})$alkenyl, $R^2$ is $(C_6\text{-}C_{30})$alkylene or $(C_6\text{-}C_{30})$alkenylene, and $X^+$is, in each case, a cation, and (b) neutralized fatty acid oligomers.

6. The composition of claim 1, wherein the composition comprises, based on 100 parts by weight of the composition, from about 4 to about 10 parts by weight of the structurant.

7. The composition of claim 1, wherein the structurant comprises one or more alkanolamide compounds according to structure (III):

(III)

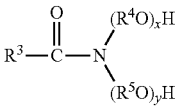

wherein:

$R^3$ is $(C_5\text{-}C_{24})$ saturated or unsaturated, straight chain or branched aliphatic group, $R^4$ and $R^5$ are the same or different, $C_2C_4$ straight chain or branched aliphatic groups, x is an integer from 0 to 10, y is an integer from 1 to 10, and the sum of x and y is less than or equal to 10.

8. The composition of claim 1, wherein the composition comprises, based on 100 parts by weight of the structured soap composition from about 1 to about 12 parts by weight of the electrolyte.

* * * * *